US005404737A

United States Patent [19]

Hötzl

[11] Patent Number: 5,404,737

[45] Date of Patent: Apr. 11, 1995

[54] ELECTRICALLY AND MANUALLY KEY-CONTROLLED LOCK

[75] Inventor: Manfred Hötzl, Graz, Austria

[73] Assignee: Roto Frank Eisenwarenfabrik Aktien, Karlsdorf bel Graz, Austria

[21] Appl. No.: 40,340

[22] Filed: Mar. 30, 1993

[30] Foreign Application Priority Data

Apr. 1, 1992 [AT] Austria ..... 666/92

[51] Int. Cl.[6] ..... F05B 47/00

[52] U.S. Cl. ..... 70/279; 292/144; 70/118

[58] Field of Search ..... 70/277, 278, 279, 280, 70/103, 104, 118; 292/144, 201, 39

[56] References Cited

U.S. PATENT DOCUMENTS

| | | | |
|---|---|---|---|
| 656,011 | 8/1900 | Carleton | 70/277 |
| 3,933,382 | 1/1976 | Counts et al. | 70/280 |
| 4,674,781 | 6/1987 | Reece et al. | 292/201 |
| 5,148,691 | 9/1992 | Wallden | 70/279 |

FOREIGN PATENT DOCUMENTS

| | | | |
|---|---|---|---|
| 2667105 | 3/1992 | France | 70/277 |

*Primary Examiner*—Peter M. Cuomo

*Assistant Examiner*—Darnell M. Boucher

*Attorney, Agent, or Firm*—Herbert Dubno; Andrew Wilford

[57] ABSTRACT

A lock assembly has a main lock housing, a bolt movable in the housing between a locked position projecting from the housing and an unlocked position largely recessed in the housing and a double cylinder having an outside key-operable part rotatable by an appropriately bitted key and an inside part rotatable by the outside part and also rotatable independently of the outside part. The inside part carries an actuator movable on rotation of either part. A gear linkage between the actuator and the bolt displaces the bolt. A secondary housing is provided adjacent the lock housing and an actuator element coupled and movable with the linkage extends from the lock housing to the secondary housing. The element moves relative to the secondary housing on movement of the bolt between its positions. An electric motor on the secondary housing connected to the element is energizable for displacing same and thereby also displacing the bolt between its positions. A key-operated switch connected to the electric motor energizes this motor to allow electrical as well as manual actuation of the locking same.

6 Claims, 1 Drawing Sheet

ELECTRICALLY AND MANUALLY KEY-CONTROLLED LOCK

FIELD OF THE INVENTION

The present invention relates to a key-controlled lock. More particularly this invention concerns such a lock which can be opened both manually and with a power assist.

BACKGROUND OF THE INVENTION

A standard key-controlled lock has a cylinder whose core can be rotated by an appropriately bitted key to turn an actuating element linked to a retractable bolt or the like. The right key is inserted in the cylinder to rotate its core and actuate the lock. On the inside of the door the lock can have a knob that is also connected to the actuator so that the bolt can be extended or retracted from inside without using the key.

In a powered lock a code is entered or key employed to operate a motor that itself extends or retracts the bolt. Such a system is frequently employed, for example, in bank safe-deposit boxes or as remote door openers. In order to allow the lock to be used when power fails or the lock's battery runs down, such a lock is frequently provided with a manual override.

All such systems are fairly complex and expensive to manufacture. None is flexible and easily retrofitted to the other.

OBJECTS OF THE INVENTION

It is therefore an object of the present invention to provide an improved lock with different operating modes.

Another object is the provision of such an improved key-controlled lock which overcomes the above-given disadvantages, that is which can be operated both manually and with a power assist.

SUMMARY OF THE INVENTION

A lock assembly according to the invention has a main lock housing, a bolt movable in the housing between a locked position projecting from the housing and an unlocked position largely recessed in the housing and a double cylinder having an outside key-operable part rotatable by an appropriately bitted key and an inside part rotatable by the outside part and also rotatable independently of the outside part. The inside par carries an actuator movable on rotation of either part. A gear linkage between the actuator and the bolt displaces the bolt. A secondary housing is provided adjacent the lock housing and an actuator element coupled and movable with the linkage extends from the lock housing to the secondary housing. The element moves relative to the secondary housing on movement of the bolt between its positions. An electric motor on the secondary housing connected to the element is energizable for displacing same and thereby also displacing the bolt between its positions. A key-operated switch connected to the electric motor energizes this motor to allow electrical as well as manual actuation of the locking same.

Thus with this system it is possible to use a key in the electrical switch for power-assisted operation of the lock or in the main cylinder for standard manual operation. The use of a two-part main cylinder allows the electrical power assist to be effective along the same machine elements as the inside lock button which can be rotated independently of the outside cylinder part. Thus both manual and power-assisted operation are possible at all times, and in no way interfere with each other.

According to the invention the motor is provided with control means for stopping energization of the motor when its current consumption exceeds a predetermined limit. Furthermore the linkage includes a rack bar extending from the main housing and the lock further has a least one secondary bolt displaceable between a locked and an unlocked position, and a secondary linkage between the rack bar and the secondary bolt for displacing the secondary bolt synchronously with the first-mentioned bolt. This rack bar can form the element.

The motor of the invention is provided with a clutch connected between the motor and the element. The switch is connected to the clutch to engage and disengage it. The clutch is only closed when the motor is energized so that when the system is being operated manually the motor is disconnected and does not add to the load.

BRIEF DESCRIPTION OF THE DRAWING

The above and other objects, features, and advantages will become more readily apparent from the following, reference being made to the accompanying drawing in which.

SPECIFIC DESCRIPTION

Figure 1A:
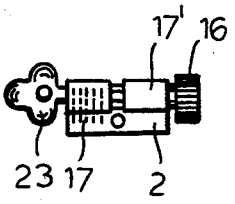
FIG. 1*a* is a view taken in the direction of arrow 1*a* of a detail of FIG. 1.
Figure 1:
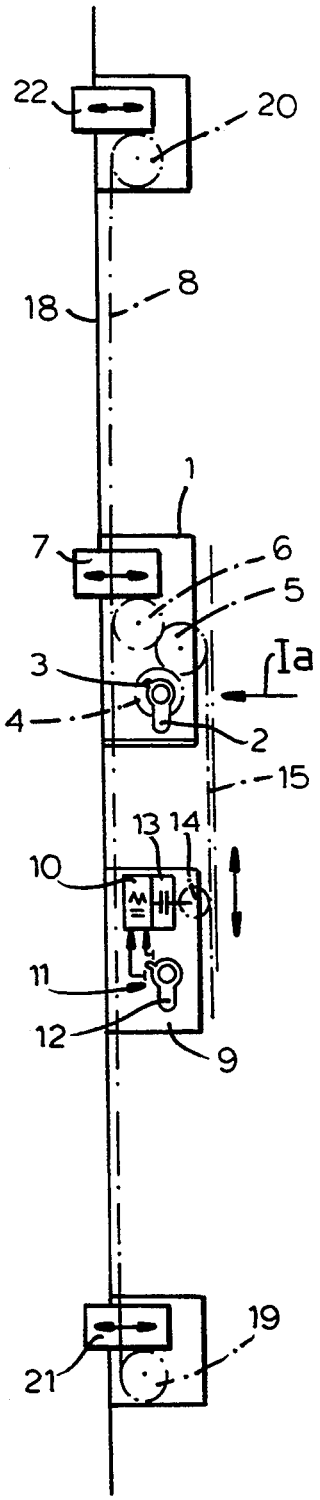
FIG. 1 is a largely schematic view of a lock assembly according to the invention.

As seen in FIG. 1 a main lock housing 1 mounted along a door edge 18 has a standard key-operated cylinder 2 having in turn an actuating element 3 that can rotate a gear wheel 4 when an appropriately bitted key 23 is inserted in the cylinder 2 and turned. The wheel 4 is connected via a linkage formed by two more gear wheels 5 and 6 to a primary door bolt 7 that can move from the illustrated locked position extending past the door edge 18 to a position recessed in the door edge 18 and housing 1.

FIG. 1*a* shows how the cylinder 2 is of the two-part type, having a front or outside part 17 that accepts the key 23 and that is provided with tumblers so it can rotate only when the appropriately bitted key 23 is inserted in it, and a rear part 17' that has no such tumblers. The rear part 17' is provided with a standard knob 16 and is itself the part provided with the actuator 3. Thus this actuator 3 can be pivoted about the axis of the cylinder 2 either by means of the key 23 or by the knob 16.

A connecting bar 8 formed as a rack meshes with the gear wheel 6 and with further gear wheels 19 and 20 that are provided outside the housing 1 in mesh with secondary bolts 21 and 22. The gearing is such that when the key 23 is rotated in the cylinder the secondary bolts 21 and 22 will move out and in synchronously with the primary bolt 7.

In accordance with the invention a secondary bar 15 formed as a rack meshes at one end with the gear 5 and at its other end with another gear 14 connected via a clutch 13 to a motor 10 provided in a secondary housing 9 spaced from the main housing 1. A second single-part cylinder 12 that is normally exposed at the outside of the door having the edge 18 is provided in this housing 9 and can operate a reversing switch 11 for the motor 10. In addition this motor 10 is provided internally with an automatic overload protector that shuts it down and opens the clutch 13 when the current consumption of the motor 10 exceeds a predetermined limit that is reached if the motor 10 stalls.

This device operates as follows:

For manual operation the key 23 is inserted into the cylinder 2 and rotated to rotate the gears 5 and 6 and lift the bar 15, thereby extending the bolts 7, 21, and 22 to their locked positions. Opposite rotation of the key 23 oppositely moves the linkage gears 5 and 6 and the bolts 7, 21, and 22 to open the lock. The clutch 13 is normally open so that on manual operation the motor 10 does not have to be turned over. From inside the lock can be operated manually by using the knob 16 instead of the key 23.

For electrical operation the key switch 12 is tipped in one direction to operate the switch and start the motor 10 in the appropriate direction. The clutch 13 is automatically closed when the motor 10 is energized so that the motor rotates the gear 14, thereby moving the bar 15 in the appropriate direction to operate the linkage 5, 6 as if the key 23 or knob 16 were working it. Depending on the direction the key for the cylinder 12 is moved, the lock will open or close.

Figure 2:
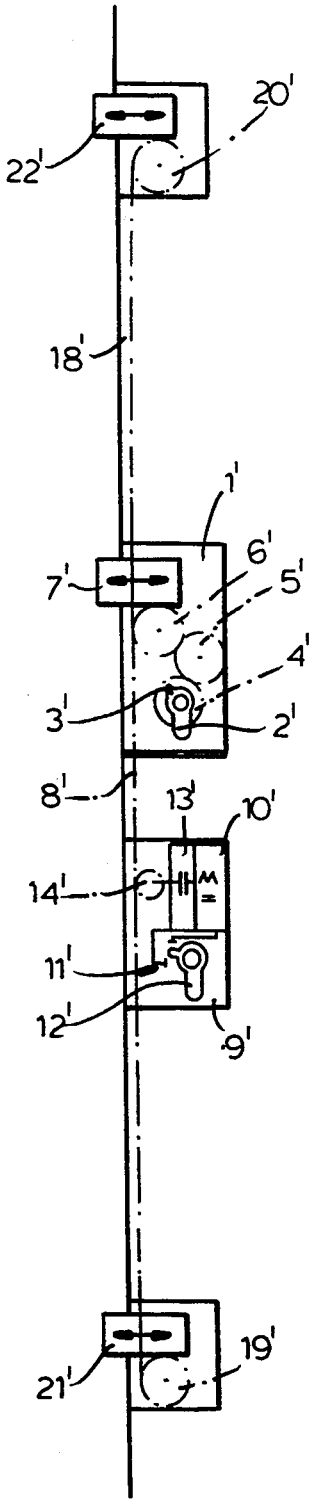
FIG. 2 is a view like FIG. 1 of another assembly in accordance with this invention.

In the arrangement of FIG. 2, where reference numerals for structure identical to that of FIG. 1 is used but carrying primes (′), a separate actuator bar 15 is dispensed with. Instead the bar 8′ that operates the remote linkage gears 19′ and 20′ meshes with the motor gear 14′. Once again, this bar 8′ is fitted in a guide slot in the housing 9′, like the bar 15 of FIG. 1.

I claim:

1. A lock assembly for use on a door having an inside face and an outside face, the assembly comprising:

a main lock housing;

a first bolt movable in the housing between a locked position projecting from the housing and an unlocked position largely recessed in the housing;

a double cylinder having an outside key-operable part exposed on the outside face of the door and rotatable by an appropriately bitted key, an inside part rotatable by the outside part and also rotatable independently of the outside part and having an actuator movable on rotation of either part, and a knob on the inside face of the door and coupled directly to the inside part;

a gear linkage between the actuator and the first bolt and including a rack bar extending from the main housing for displacing the first bolt by means of the actuator, whereby the outside part or the knob can displace the first bolt between its positions;

a secondary housing adjacent the lock housing;

at least one secondary bolt displaceable between a locked and an unlocked position;

a secondary linkage between the rack bar and the secondary bolt for displacing the secondary bolt synchronously with the first bolt;

an actuator element coupled and movable with the linkage and extending from the lock housing to the secondary housing, the element moving relative to the secondary housing on movement of the first bolt between its positions;

drive means including a reversible electric motor on the secondary housing connected to the element and energizable for displacing same and thereby also displacing the first bolt between its positions; and means including a key-operated switch displaceable between two positions and connected to the electric motor for energizing same in respective directions for moving the first bolt into the locked and unlocked positions.

2. The lock assembly defined in claim 1 wherein the motor is provided with control means for stopping energization of the motor when its current consumption exceeds a predetermined limit.

3. The lock assembly defined in claim 1 wherein the rack bar forms the element.

4. The lock assembly defined in claim 1 wherein the linkage includes at least one toothed gear, the element being a rack bar meshing with the gear.

5. The lock assembly defined in claim 1 wherein the motor is provided with a clutch connected between the motor and the element, the switch being connected to the clutch to engage and disengage it.

6. A lock assembly for use on a door having an inside face and an outside face, the assembly comprising:

a main lock housing;

a main bolt movable in the housing between a locked position projecting from the housing and an unlocked position largely recessed in the housing;

a secondary bolt movable on the door between a locked position projecting from the door and an unlocked position largely recessed in the door;

a double cylinder having an outside key-operable part exposed on the outside face of the door and rotatable by an appropriately bitted key, an inside part rotatable by the outside part and also rotatable independently of the outside part and having an actuator movable on rotation of either part, and a knob on the inside face of the door and coupled directly to the inside part;

a gear linkage between the actuator and the main bolt for displacing the main bolt by means of the actuator;

a link bar between the gear linkage and the secondary bolt for displacing the secondary bolt by means of the actuator, whereby the outside part or the knob can displace the bolts between their positions;

a secondary housing spaced from the lock housing and adjacent the link bar;

an actuator element on the secondary housing coupled with the link bar;

drive means including a reversible electric motor on the secondary housing connected to the element and energizable for displacing same and thereby also displacing the bolts between their positions; and means including a key-operated switch on the secondary housing displaceable between two positions and connected to the electric motor for energizing same in respective directions for moving the bolts into the locked and unlocked positions.

* * * * *